United States Patent [19]

Kalberer et al.

[11] Patent Number: 4,830,273

[45] Date of Patent: May 16, 1989

[54] PLASTIC POUR SPOUT BONDING

[75] Inventors: Roderick W. Kalberer, Salisbury Mills; Robert L. Gordon, Monroe, both of N.Y.

[73] Assignee: International Paper Company, Tuxedo, N.Y.

[21] Appl. No.: 189,453

[22] Filed: May 2, 1988

[51] Int. Cl.[4] ..... B65D 39/08; B65D 43/16

[52] U.S. Cl. ..... 229/123.1; 220/265; 220/288; 220/359; 222/541; 229/125.08; 229/125.15; 229/125.42; 229/160.2

[58] Field of Search ..... 206/631, 631.2; 222/541, 545, 556; 220/265, 288, 359; 229/125.08, 125.14, 125.15, 125.24, 125.33, 125.42, 160.2, 123.1, 123.2, 125.09, 125.11

[56] References Cited

U.S. PATENT DOCUMENTS

| | | | |
|---|---|---|---|
| 2,340,651 | 2/1944 | Denison | 229/123.1 |
| 2,400,716 | 5/1946 | Sattler | 229/125.15 |
| 2,738,916 | 3/1956 | Peters | 229/125.05 |
| 3,183,798 | 5/1965 | Kuhnle | 493/213 |
| 3,711,011 | 1/1973 | Kugler | 229/485 B |
| 3,966,079 | 6/1976 | Kawamata | 220/359 |
| 3,990,603 | 11/1976 | Brockman | 220/260 |
| 4,189,060 | 2/1980 | Trotman, III | 220/260 |
| 4,372,460 | 2/1983 | Brochman et al. | 220/359 |
| 4,378,074 | 3/1983 | Brochman | 220/359 |
| 4,715,528 | 12/1987 | Kjelgaard et al. | 220/359 |
| 4,770,325 | 9/1988 | Gordon et al. | 222/541 |

FOREIGN PATENT DOCUMENTS

| | | | |
|---|---|---|---|
| 1324348 | 3/1963 | France | 229/160.2 |

*Primary Examiner*—Gary Elkins

*Attorney, Agent, or Firm*—Walt T. Zielinski

[57] ABSTRACT

A paperboard carton for containing and pouring liquid has a pour spout fitment adhesively secured to its upper surface and at least partially over a reinforcing patch on said upper surface to spread the upward force exerted by opening the fitment over an area of the carton surface larger than the bottom surface of the fitment so as to prevent the fitment from being torn away from the carton surface. In addition to the force distribution, the tensile strength of the added patch material is much greater than the strength of the carton coating, thus this new patch material becomes the primary seal.

8 Claims, 3 Drawing Sheets

PLASTIC POUR SPOUT BONDING

BACKGROUND OF THE INVENTION

This invention relates to a paperboard carton blank and carton for packaging and dispensing potable liquid such as milk through a pour spout.

A preferred embodiment comprises a carton which is made from a flat blank from which it is poured, the outside surface of which is coated with a plastic such as polyethlylene to give it strength and make it liquid impervious.

One form of it has a separate pour spout structure, preferably made of plastic, which includes a base part with an opening in it, secured to the carton surface and a cover or closure part releasably secured to the base part and over the opening to form a seal.

The cover may have a pull tab by which it may be grasped by the user to pull it away from the base part to expose the pour opening.

It has been found that many times, in lifting the cover, the user also pulls the base part at least partially away from the carton surface thus disrupting the proper function of the pour spout.

It is accordingly the general object of this invention to prevent this tearing away of the pour spout fitment by strengthening the bond between the fitment and the surface of the carton.

SUMMARY OF THE INVENTION

As will appear in the more detailed description and drawings, the carton, when erected from the blank, may, among others, be either of the so-called gable top or flat top type. The pour spout fitment is located on one of its upper surfaces preferably over a pour opening in the carton blank surface. It has a base part normally with a pour opening in it to register with the pour opening in the carton surface, and a removable closure part over the base part.

Before applying the spout fitment to the carton surface, a reinforcing patch is applied to the surface. This patch is of such shape and size that when the fitment is applied over it, the patch extends beyond the outer edges of the fitment.

The fitment is then adhesively applied either partly directly to the plastic coated carton surface and partly to the reinforcing patch, or else entirely over the patch.

Thus, when the user applies force to remove the cover part from the base part, the force is spread through the reinforcing patch and over a substantially greater area than that covered by the base part, in addition the strength of the patch is now the controlling factor, thereby strengthening the bond between the fitment and the carton and preventing the fitment from being partially or entirely torn away from the carton surface.

DETAILED DESCRIPTION

Figure 1:
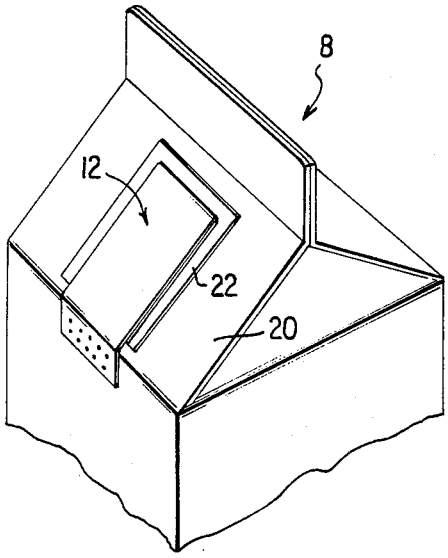
FIG. 1 is a partial perspective view of the top of a gable top carton showing one form of the pour spout arrangement of the invention.

Two of several types of carton included in this invention to contain and pour liquid are indicated at 8 and 10 in FIGS. 1–7 inclusive. The carton type 8 is a gable top carton and the type 10 is a flat top type.

The pour spout arrangment of the invention may take several forms any of which may be combined with the carton types 8 and 10 shown and others.

One such pour spout form is indicated at 12 in FIGS. 1 and 3, 6 and 7 and 8–11 inclusive. An alternate form of pour spout is indicated at 14 in FIGS. 4 and 5.

While the pour spout fitments of FIGS. 1 and 3, 6 and 7 and 8–11 are essentially the same, the attachment of the fitments 12 of FIGS. 8–11 to the carton are different from that of the others shown as further explained.

The invention covers the pour spout arrangements in cartons exemplified by those 8 and 10 of FIGS. 1–7 inclusive and in carton blanks parts of which are indicated at 16 in FIGS. 8–11 inclusive for making such cartons.

Figure 2:
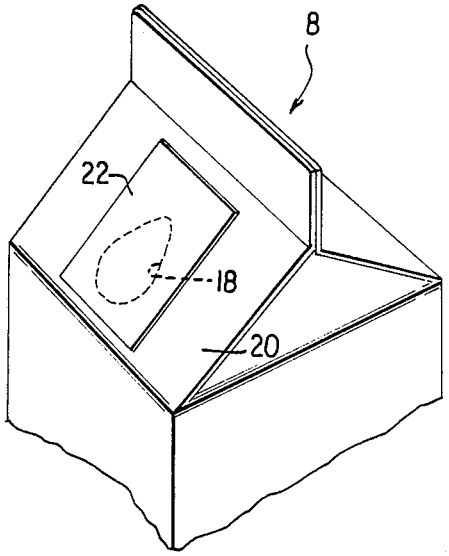
FIG. 2 is a view similar to FIG. 1, but with the pour spout fitment omitted thus showing more clearly the reinforcing patch first placed in the selected area on the carton upper surface part and over its pour hole.
Figure 3:
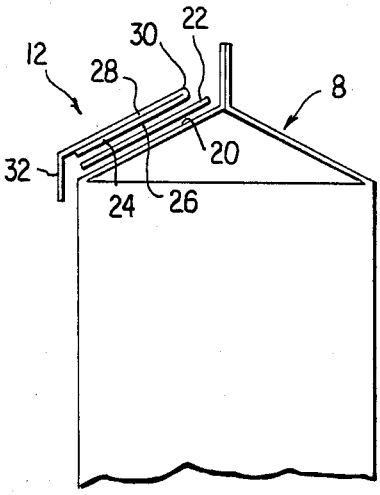
FIG. 3 is an elevation view showing the parts of the pour spout arrangement of FIG. 1 in exploded aspect.

Referring particularly to FIG. 2, a pour hole 18 may be formed in a selected area of part of a carton blank which becomes the center of an upper surface part 20 of a carton 8 although this may not be essential.

A reinforcing patch 22 is adhesively secured or sealed using the various methods available in the industry to secure polymers together to this upper surface carton part 20 in the selected area and squarely over the pour hole 18. The patch 22 may or may not also have a corresponding pour hole according to the characteristics desired in a particular structure. If it does have a pour hole, the latter will be located in register over the hole 18 in the carton 8. If it does not, the intent will be to have the patch function as a seal until pierced by the end user of the carton in order to be able to pour the contained liquid. In this latter case the characteristic of the material to be used for the patch will be selected so that it may be readily pierced by the end user and yet strong enough to serve its primary purpose of preventing the pour spout fitment 12 or 14 to be attached to the carton from being accidentally torn away from the carton surface while being opened as further described.

The variation in degree of desirable strength of the patch material results from the type of material selected for its use and its thickness and will depend upon end usage needs. For instance, it will most often be used on polyethylene coated paperboard stock for making liquid cartons.

Examples of compatible materials are 2 to 6 mil low density polyethylene, a lamination of 1 mil low density polyethylene, polyester and 1 mil low density polyethylene, 2 mils high density polyethylene, and a lamination of 1 mil high density polyethylene, polyester and 1 mil high density polyethylene.

These patch materials may be applied to the polyethylene coated carton surface with pressure sensitive adhesive, by direct heat, radiant heat, hot air or impulse heating under pressure with a short surge of heat.

The pour spout fitment 12 of FIGS. 1 and 3, 6 and 7 and 8–11 best seen in FIGS. 8–11 may be made of 30 mil high density polyethylene. It has a base part 24 which includes a flat bottom portion 26 which may be adhesively secured by any of the methods mentioned above to either of the upper surface parts 20 or 20*a* of the cartons 8 and 10 either partially or entirely over the reinforcing patch 22.

It also has a closure part 28 hinged at 30 to the base part 24 and removably secured as by contact gluing to the base part. When so secured, it provides a leak proof closure over the pour hole 18 and when removed from the base part by pulling it upwardly so as to pivot it around the hinge 30, it opens the pour hole to allow the contained liquid to be poured out or otherwise removed as with use of a straw.

The closure part 28 has a pull tab 32 by which it may be grasped to raise it. When the seal between the closure part 28 and the base part 24 is suddenly broken by this upward force, the strain is transferred to the area of the hinge 30 and tends to tear the fitment 12 away from its attachment to the upper surface 20 or 20*a* of the carton.

By the use of the reinforcing patch 22 this strain is distributed over an area much larger than the area of the flat bottom portion 26, thus preventing the fitment 12 from being torn away. In addition to the force distribution, the tensile strength of the added patch material is much greater than the strength of the carton coating, thus this new patch material becomes the primary seal. For example, the typical one mil PE coating has a tensile strength of five pounds and the two mil patch material has a tensile strength of fifteen pounds. The seal strength of the fitment to the carton is now a combined total of twenty pounds.

Figure 4:
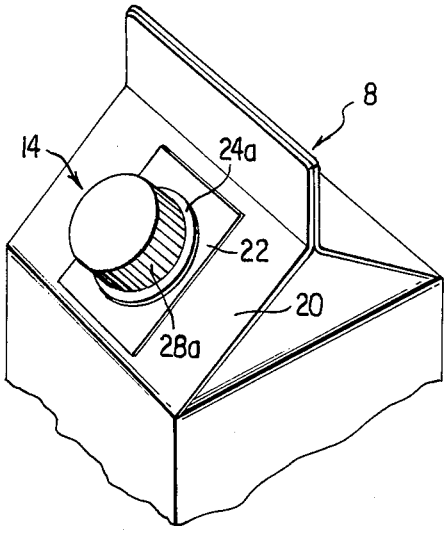
FIG. 4 is a partial perspective view of the top of a gable top carton showing an alternate form of the pour spout arrangement of the invention.
Figure 5:
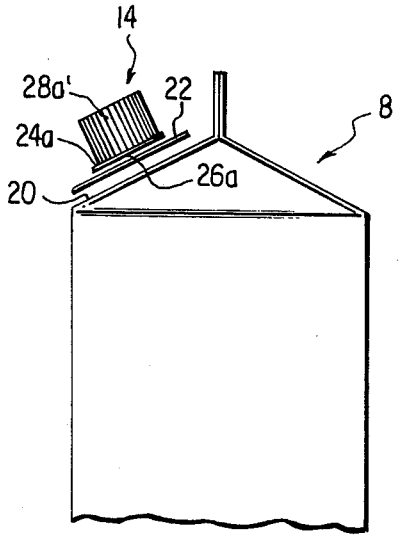
FIG. 5 is an elevation view showing the parts of the pour spout arrangement of FIG. 4 in exploded aspect.
Figure 6:
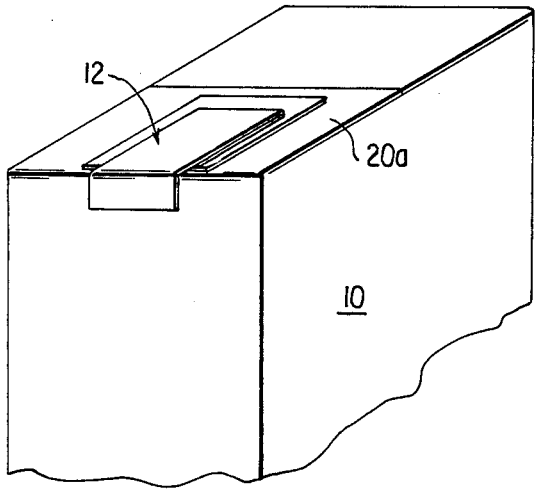
FIG. 6 is a partial perspective view of the top of a flat top container showing a pour spout arrangement of the invention similar to that of FIG. 1.
Figure 7:
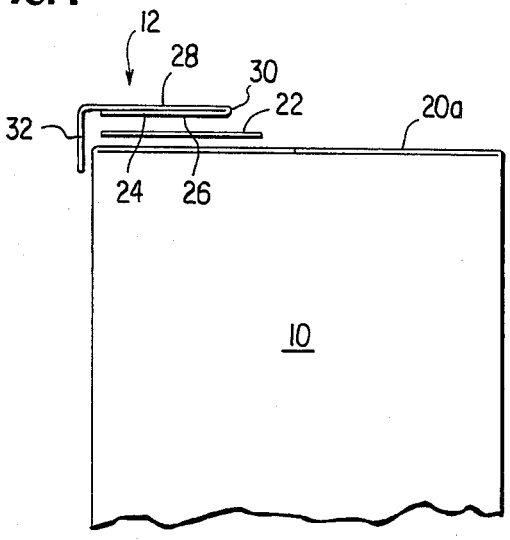
FIG. 7 is an elevation view showing the parts of the pour spout arrangement of FIG. 6 in exploded condition.
Figure 8:
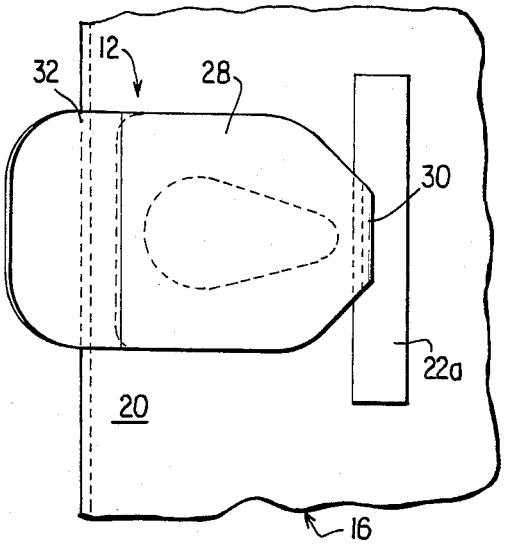
FIG. 8 is a plan view of a pour spout fitment similar to that of FIGS. 1–3, 6 and 7 in closed condition on a carton blank (fragmented) but with a different arrangement with respect to a reinforcing patch.
Figure 9:
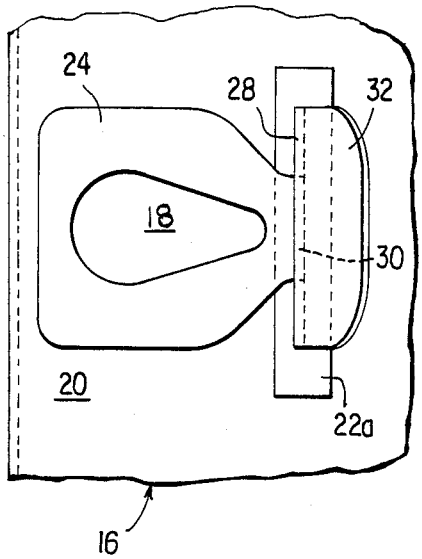
FIG. 9 is a plan view of the fitment of FIG. 8 in open condition.
Figure 10:
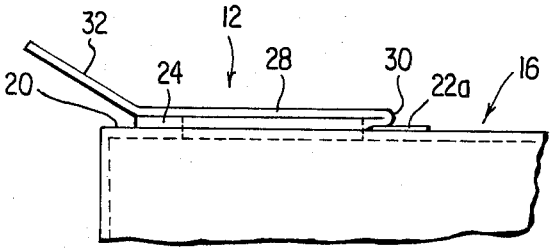
FIG. 10 is a detailed side elevation view of the fitment of FIGS. 8 and 9 in closed condition.
Figure 11:
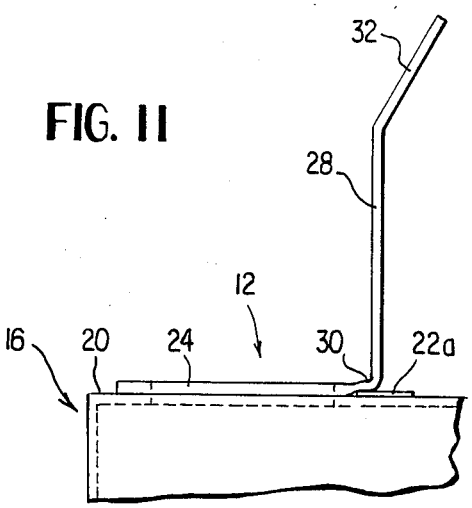
FIG. 11 is a view similar to FIG. 10 of the fitment in open condition.

An alternate form of pour fitment is indicated at 14 in FIGS. 4 and 5. It has a base part 24*a* which in turn has a flat bottom portion 26*a* adhesively secured to either of the upper surface parts 20 and 20*a* of the cartons 8 and 10 either partially or entirely over the reinforcing patch 22. It also has a closure part 28*a* which screws on to the base part 24*a*.

Thus, the strain of removing the closure part 28*a* is distributed by the reinforcing patch over an area greater than the area of the flat bottom portion of the fitment 14 thereby preventing it from being torn away.

A fitment 12 is seen in FIGS. 8–11 which is essentially the same as those shown in FIGS. 1, 3, 6 and 7 except that it is shown mounted on that part 16 of a carton blank which will become the upper surface part of a carton.

It is illustrated to show that the flat bottom portion 24 of the fitment 12 need be secured to the upper surface part 20 of the carton blank and carton only partially over a reinforcing patch 22*a*. In this situation the patch 22*a* will lie primarily under the hinge part 30 of the fitment where the greatest upward strain will be exerted when the closure part 28 is raised to open the fitment 12. In this manner, the patch 22*a* may be much smaller thus saving cost and eliminating the need of a pour hole in it or the need to pierce it for pouring.

The size of the patch must be greater than the actual fitment. If for example it were the same size, the strain at the hinge point would be transferred to the carton coating thus resulting in reduced strength.

What is claimed is:

1. A paperboard blank for a carton to contain and from which to pour liquid comprising:

(a) an upper surface part, (b) a reinforcing patch adhesively secured to said upper surface part at a selected area, (c) a pour spout fitment having a base part which includes a flat bottom portion adhesively secured to said upper surface part at said selected area and at least partially over said reinforcing patch, (d) said fitment having a closure part removably secured to said base part, the strain imposed upon said fitment by the removal of said closure part being distributed by said reinforcing patch over an area greater than the area of the said flat bottom portion of the fitment, thereby preventing the said fitment from being torn away from the said upper surface part.

2. A carton formed from the blank as set forth in claim 1.

3. A blank as set forth in claim 1 in which the said fitment is at least partly formed of plastic.

4. A blank as set forth in claim 1 in which the said fitment parts are both formed from plastic in a single piece and are interconnected along a fold line.

5. A blank as set forth in claim 1 in which the said reinforcing patch is formed of plastic.

6. A blank as set forth in claim 4 in which the said fitment parts are heat sealed to each other, and the base part is heat sealed to the reinforcing patch and the reinforcing patch is heat sealed to the top surface of the blank.

7. A blank as set forth in claim 1 in which the reinforcing patch is formed at least in part of 1 to 6 mil polyethylene.

8. A blank as set forth in claim 1 in which the said blank is coated with polyethylene.

* * * * *